United States Patent [19]

Plaza

[11] Patent Number: 4,562,619

[45] Date of Patent: Jan. 7, 1986

[54] CLASPING DEVICE OF DOUBLE FUNCTION FOR NECKLACES, BRACELETS AND SIMILAR ARTICLES

[76] Inventor: Jaime P. Plaza, Infanta Carlota Joaquina 123-127 7°, Barcelona, Spain

[21] Appl. No.: 614,726

[22] Filed: May 25, 1984

[30] Foreign Application Priority Data

Dec. 28, 1983 [ES] Spain ..... 275.595

[51] Int. Cl.[4] ..... F16G 15/04

[52] U.S. Cl. ..... 24/116 R; 24/116 A; 24/616

[58] Field of Search ..... 24/116 R, 116 A, 616, 24/618, 265 WS, 70 J, 71 J, 585

[56] References Cited

U.S. PATENT DOCUMENTS

| | | | |
|---|---|---|---|
| 388,021 | 8/1888 | Byrne | 24/116 R |
| 2,113,786 | 4/1938 | Garfinkel | 24/616 |
| 2,930,209 | 3/1960 | Altman | 24/116 A |
| 3,094,754 | 6/1963 | Wayne | 24/116 A |
| 3,114,187 | 12/1963 | Wayne | 24/116 A |
| 3,181,217 | 5/1965 | Bohlinger et al. | 24/116 A |
| 3,271,977 | 9/1966 | Bohlinger et al. | 24/116 R |
| 3,309,743 | 3/1967 | Verri | 24/116 R |
| 3,323,324 | 6/1967 | Bohlinger et al. | 24/116 A |
| 3,481,155 | 12/1969 | Cook | 24/116 R |

*Primary Examiner*—Victor N. Sakran
*Attorney, Agent, or Firm*—Michael J. Striker

[57] ABSTRACT

A clasping device for necklaces, bracelets and the like and including two juxtaposed parts, having back faces, and hooking and articulation components attached to the backfaces of the parts and further including a continuous first ring solidly attached to one of the parts and having an arc extending to an articulation point disposed on the other of the parts, the arc forming a second ring when the clasping device is clasped which occurs when the two parts become flush and at the same level with each other.

8 Claims, 6 Drawing Figures

CLASPING DEVICE OF DOUBLE FUNCTION FOR NECKLACES, BRACELETS AND SIMILAR ARTICLES

BACKGROUND OF THE INVENTION

This invention relates to a clasping device for necklaces, bracelets and the like. More particularly, it relates to a clasping device for necklaces, bracelets and the like, and has at least two parts.

Clasping devices for necklaces, bracelets and the like of the above mentioned general type are known in the art. The known clamps or fasteners for application on necklaces, bracelets and the like are normally of a very simple construction and operation and only accomplish a single function. This is so because they are sized in such a way that they cannot be used as an adornment or pectoral pendant.

SUMMARY OF THE INVENTION

Accordingly, it is an object of the present invention to provide a clasping device for necklaces, bracelets and the like which avoids the disadvantages of the prior art.

More particularly, it is an object of the present invention to provide a clasping device for necklaces, bracelets and the like which serves two functions, that is, to be ornamental in addition to being a fastener.

In keeping with these objects, and with others which will become apparent hereinafter, one feature of the present invention resides, briefly stated, in a clasping device for necklaces, bracelets and the like including two juxtaposed parts having back faces, wherein hooking and articulation means are attached to the backfaces of the parts and include a continuous first ring solidly attached to one of the parts, and having an arc extending to an articulation point disposed on the other part, and forming a second ring when the clasping device is clasped which occurs when the two parts become flush and at the same level with each other.

When the clasping device for necklaces, bracelets and the like is designed in accordance with the present invention, the front faces of the two parts are available for ornamentation while the back faces accommodate the clasping means.

In accordance with another feature of the present invention, the two parts are flat and symmetrical.

Still another feature of the present invention is that the parts have front faces containing elements and motifs for adornment such as pearls, gems or engravings.

A further feature of the present invention is that one end of the necklace passes through the first ring so that the necklace becomes permanently affixed to the first ring, while the other end of the necklace remains free to be hooked or unhooked from the second ring, and when the other end of the necklace is unhooked from the second ring the two parts become disposed at different levels from each other and achieve the unclasped position.

Finally, still a further feature of the present invention is that the parts have a mutual touching point that creates sliding friction which immobilizes the parts in the clasped position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
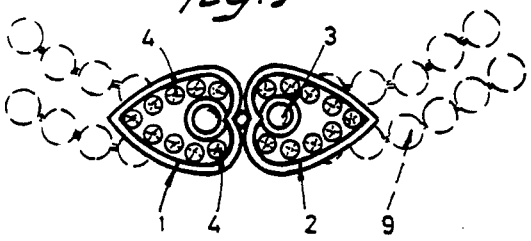
FIG. 1 is a front view of the clasp of the present invention.

In FIG. 1 is shown that the clasp of the present invention consists of two preferentially flat and symmetrical parts 1 and 2. Parts 1 and 2 are made of a material and contour which allow different adornment notifs 3 and 4 such as pearls, gems, engravings and the like to show on their external faces. However, the material of parts 1 and 2 is normally a metal or a metallic alloy.

Figure 2:
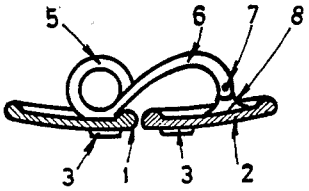
FIG. 2 is a plan view in partial section of the clasp of FIG. 1 shown in its clasped position.
Figure 3:
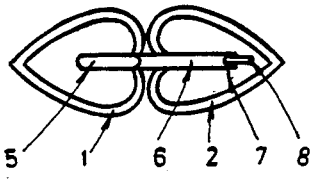
FIG. 3 is a rear view of the clasp of FIG. 1.

The rear faces of parts 1 and 2 are recessed. A continuous ring 5 is joined to the rear face of part 1. The ring 5 has an extension 6 formed as an arc that is pivotedly mounted at articulation part 7 to a lug 8 disposed solidly on the part 2. This can be clearly seen from FIGS. 2 and 4.

Figure 4:
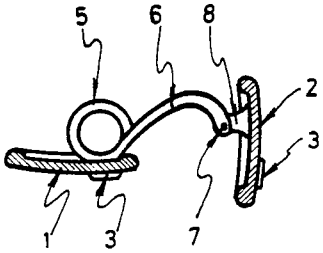
FIG. 4 is a plan view in partial section of the clasp of FIG. 1 shown in its unclasped position.
Figure 5:
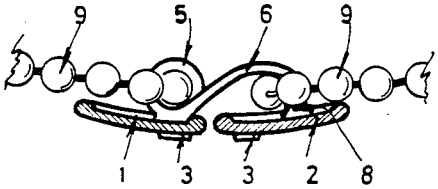
FIG. 5 is a plan view in partial section of the clasp of FIG. 2 shown with the applied pearls of a necklace.
Figure 6:
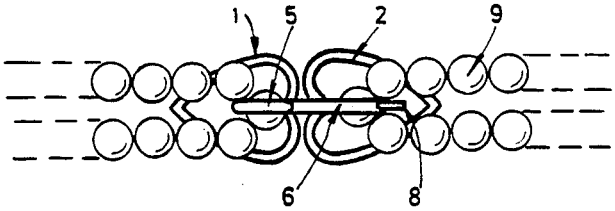
FIG. 6 is a rear view of the clasp of FIG. 3 shown with the applied pearls of a necklace.

The clasp can achieve two positions, a clasped position (shown in FIGS. 2, 3, 5 and 6) and an unclasped position (shown in FIG. 4). The articulation point 7 allows the transition between the two positions. Once the clasp achieves its clasped position, the arc 6 will act equally as a ring.

The pearl, glass bead necklace, bracelet or the like 9 forms a string that has one of its ends passed through the closed ring of the part 1. The other end is inserted into the arc 6 (FIGS. 5 and 6), after the part 2 has been opened (FIG. 4) so as to allow the string to pass through. Once the device is clasped, by raising up part 2 to meet the arc extension 6, parts 1 and 2 assume substantially the same level (FIG.5) and behind them the pearl string 9 or the like is hooked and held closed. One end of the string is permanently joined to part 1, while the other end is free for clasping and unclasping to the part 2 and thus allowing for the release of the free end. The mutual immobilization of the parts 1 and 2 in the clasped position (FIGS. 1, 2, 3, 5 and 6) is obtained by the frictional forces present between parts 1 and 2, at their central touching points.

When the article 9 is a necklace,clasp parts 1 and 2 act as a pectoral pendant (locket) in addition to a fastener. The pectoral pendant will stand out due to its fine appearance. The shape, dimensions and characteristics of the ornamental external faces of parts 1 and 2 are infinitely variable.

Although the clasp is for a necklace containing two loops of pearls or the like, it can also be used for a necklace containing only one loop of pearls or the like. In this case, the ends of the string would form loops which would be passed through (one in a permanent way and the other freely) and into the ring 5 and extension arc 6, fitted on the back faces of the parts 1 and 2.

It will be understood that each of the elements described above, or two or more together, may also find a useful application in other types of necklaces, bracelets and the like, differing from the types described above.

While the invention has been illustrated and described as embodied in a bracelet, necklace or the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A clasping device for jewelry formed in an enclosed ring, such as necklaces, bracelets and the like, comprising: two juxtaposed parts, a first immovable part having a back face, and a second part having a back face and being pivotable relative to said first part between an unclasped position in which said first part and said second part are located in substantially perpendicular planes and a clasped position in which said first and said second part are located in substantially the same plane; and hooking and articulating means attached to each face of said first and said second part, said means including a continuous first ring solidly attached to said first part and being formed so that the closed ring of the jewelry is passable therethrough and permanently mountable therein, and an arc member having two ends, a first end connected to said first part and a second end connected to said second part at an articulation point so that said second part is pivotable on said second end of said arc member, said arc member forming a second ring when said second part is pivoted into said clasped position, the closed ring of jewelry being selectively hookable and unhookable on said second ring formed by said arc member when said second part is pivoted into said unclasped position, said second part and said arc member cooperating together so as to securely hold the closed ring of jewelry when said second part is in said clasped positon.

2. The clasping device as defined in claim 1, wherein said two parts are flat and symmetrical.

3. The clasping device as defined in claim 1, wherein said parts have front faces containing elements and motifs for adornment.

4. The clasping device as defined in claim 3, wherein said elements and motifs for adornment include pearls.

5. The clasping device as defined in claim 3 wherein said elements and motifs for adornment include gems.

6. The clasping device as defined in claim 3 wherein said elements and motifs for adornment include engravings.

7. The clasping device as defined in claim 1, wherein said parts have a mutual touching point that creates sliding friction which immobilizes said parts in said clasped position.

8. The clasping device as defined in claim 1, wherein said parts are arranged so that in said clasped position they are flush with one another.

* * * * *

UNITED STATES PATENT AND TRADEMARK OFFICE

CERTIFICATE OF CORRECTION

PATENT NO. : 4 562 619

DATED : January 7,1986

INVENTOR(S) : Jaime P. Plaza

It is certified that error appears in the above—identified patent and that said Letters Patent is hereby corrected as shown below:

On the title page insert:

-- (73) Assignee: MAJORICA S.A.
Barcelona, Spain --.

Signed and Sealed this

Eighteenth Day of July, 1989

*Attest:*

DONALD J. QUIGG

*Attesting Officer*

*Commissioner of Patents and Trademarks*